US010829712B2

(12) United States Patent
Hartley

(10) Patent No.: US 10,829,712 B2
(45) Date of Patent: Nov. 10, 2020

(54) LUBRICATING OIL COMPOSITIONS

(71) Applicant: Infineum International Limited, Abingdon (GB)

(72) Inventor: Joseph P. Hartley, Oxford (GB)

(73) Assignee: INFINEUM INTERNATIONAL LIMITED, Abingdon (GB)

( * ) Notice: Subject to any disclaimer, the term of this patent is extended or adjusted under 35 U.S.C. 154(b) by 0 days.

(21) Appl. No.: 15/637,036

(22) Filed: Jun. 29, 2017

(65) Prior Publication Data

US 2018/0002628 A1 Jan. 4, 2018

(30) Foreign Application Priority Data

Jun. 30, 2016 (EP) ..... 16177243

(51) Int. Cl.

| | |
|---|---|
| ***C10M 125/04*** | (2006.01) |
| ***C10M 163/00*** | (2006.01) |
| ***C10M 141/12*** | (2006.01) |
| ***C10M 125/22*** | (2006.01) |
| ***C10M 125/26*** | (2006.01) |
| ***C10M 129/10*** | (2006.01) |
| ***C10M 129/54*** | (2006.01) |
| ***C10M 135/10*** | (2006.01) |
| *C10N 10/04* | (2006.01) |
| *C10N 10/12* | (2006.01) |
| *C10N 30/06* | (2006.01) |
| *C10N 30/00* | (2006.01) |
| *C10N 40/25* | (2006.01) |
| *C10N 60/14* | (2006.01) |

(52) U.S. Cl.

CPC ..... *C10M 125/04* (2013.01); *C10M 125/22* (2013.01); *C10M 125/26* (2013.01); *C10M 129/10* (2013.01); *C10M 129/54* (2013.01); *C10M 135/10* (2013.01); *C10M 141/12* (2013.01); *C10M 163/00* (2013.01); *C10M 2201/06* (2013.01); *C10M 2207/027* (2013.01); *C10M 2207/028* (2013.01); *C10M 2207/144* (2013.01); *C10M 2207/16* (2013.01); *C10M 2207/262* (2013.01); *C10M 2215/28* (2013.01); *C10M 2219/044* (2013.01); *C10M 2219/046* (2013.01); *C10M 2219/068* (2013.01); *C10M 2219/088* (2013.01); *C10M 2219/089* (2013.01); *C10M 2223/045* (2013.01); *C10M 2227/066* (2013.01); *C10N 2010/04* (2013.01); *C10N 2010/12* (2013.01); *C10N 2030/06* (2013.01); *C10N 2030/54* (2020.05); *C10N 2030/56* (2020.05); *C10N 2040/25* (2013.01); *C10N 2040/252* (2020.05); *C10N 2040/255* (2020.05); *C10N 2060/14* (2013.01)

(58) Field of Classification Search

CPC ..... C10M 2219/068; C10M 2219/046; C10M 2227/061; C10N 2010/12; C10N 2010/04; C10N 2040/25; C10N 2060/14

See application file for complete search history.

(56) References Cited

U.S. PATENT DOCUMENTS

| | | | | |
|---|---|---|---|---|
| 6,074,993 | A | 6/2000 | Waddoups et al. | |
| 2008/0020955 | A1* | 1/2008 | Diggs ..... | C10M 163/00 508/391 |
| 2009/0082233 | A1 | 3/2009 | Kasai | |
| 2015/0240181 | A1 | 8/2015 | Ayutsede et al. | |

FOREIGN PATENT DOCUMENTS

| | | |
|---|---|---|
| WO | WO-99/47629 A1 | 9/1999 |

* cited by examiner

*Primary Examiner* — Vishal V Vasisth

(57) ABSTRACT

A crankcase lubricating oil composition for the crankcase of a spark-ignited or compression-ignited internal combustion engine, comprising a magnesium-containing detergent, in an amount sufficient to provide from 200-4000 ppm magnesium to the lubricating oil composition, in combination with an oil-soluble or oil-dispersible molybdenum compound in an amount sufficient to provide from 600-1500 ppm molybdenum atoms to the lubricating oil composition, and with an oil-soluble or oil-dispersible boron-containing compound in an amount sufficient to provide from 200-600 ppm boron atoms to the lubricating oil composition to improve the friction and fuel economy performance.

9 Claims, No Drawings

LUBRICATING OIL COMPOSITIONS

FIELD OF THE INVENTION

The present invention relates to automotive lubricating oil compositions for four or more wheeled vehicles which exhibit improved friction characteristics. More specifically, the present invention relates to automotive crankcase lubricating oil compositions for use in gasoline (spark-ignited) and diesel (compression-ignited) internal combustion engines, such compositions being referred to as crankcase lubricants; and to the use of additives in such lubricating oil compositions for reducing friction between moving parts in use of such engines and/or improving the fuel economy performance of an engine lubricated with the lubricating oil composition.

BACKGROUND OF THE INVENTION

A crankcase lubricant is an oil used for general lubrication in an internal combustion engine where an oil sump is situated generally below the crankshaft of the engine and to which circulated oil returns. To reduce the energy and fuel consumption requirements of the engine, there is a need for crankcase lubricants that reduce the overall friction of the engine. Reducing friction losses in an engine contributes significantly to improving fuel economy performance and fuel economy retention properties. It has long been known to use friction modifiers to obtain improved friction performance.

Oil-soluble molybdenum containing additives may be used for their friction reducing properties. Examples of patent applications which refer to oil-soluble molybdenum additives for lubricating oil compositions include U.S. Pat. Nos. 4,164,473; 4,176,073; 4,176,074; 4,192,757; 4,248,720; 4,201,683; 4,289,635 and 4,479,883. It is common in some markets, such as in Japan, to use high levels of molybdenum-containing additives, such as molybdenum dithiocarbamate, as a friction modifier to achieve low friction. In such applications, up to 1000 ppm of molybdenum atoms may be present in the lubricant.

U.S. Pat. No. 6,074,993 illustrates that a combination of dimeric and trimeric molybdenum compounds can improve fuel economy and wet clutch properties in a lubricant containing ZDDP and calcium and/or magnesium sulfonate detergents.

International patent application no WO99/47629 relates to lubricant containing calcium detergents and tri-nuclear molybdenum additives for improved friction reducing properties. Data shows that a combination of trinuclear molybdenum compounds and calcium sulfonate exhibits improved retention of friction reducing properties.

It is well known to add boron to lubricating oil compositions to improve wear performance. However, in some oil compositions, high levels of boron can cause an increase in boundary friction.

International patent application WO 96/19551 discloses an engine oil comprising a boron-containing alkenyl succinimide providing the oil with greater than 800 ppm atomic boron, a molybdenum dithiophosphate or dithiocarbamate providing the oil with 50-2000 ppm molybdenum atoms, calcium salicylate providing the oil with 50-4000 ppm calcium atoms, magnesium salicylate providing the oil with 50 to 4000 ppm magnesium and optionally a copolymer of ethylene at least one other alpha-olefin monomer. The lubricating oils compositions of WO 96/19551 are stated to exhibit improved fuel economy and fuel economy retention properties.

In addition, International patent application WO 96/37582 discloses a lubricating oil composition comprising a sulfoxymolybdenum dithiocarbamate providing 200-1000 ppm molybdenum atoms to the oil, zinc dialkyldithiocarbamate containing primary alkyl groups and providing 0.04-0.15 wt % phosphorus atoms to the oil, and a mixture of 50-100 wt % calcium alkyl salicylate and 0 to 50 wt % magnesium alkyl salicylate. The lubricating oil is stated to have good antiwear properties and retention of friction-reducing properties.

U.S. Pat. No. 5,631,212 discloses a lubricating oil comprising an oil-soluble copper salt, and oil-soluble molybdenum salt, Group II metal salicylate and a borated polyalkenyl succinimide, and is stated to provide good performance for fuel economy, wear and antioxidancy.

Furthermore, European patent application number EP 0 562 172 discloses a lubricant comprising a borated alkenyl succinimide, an alkaline earth metal salt of a salicylic acid and 100-2000 ppm of molybdenum atoms from a molybdenum compound selected from molybdenum dithiophosphate and molybdenum dithiocarbamate, which is considered to be capable of reducing friction loss in an engine.

As fuel economy legislation becomes ever stricter, and engine designs change fuel economy tests are becoming more closely aligned with engine operations. It is increasingly important to reduce friction and thus improve fuel economy across the full range of operating temperatures of the engines, including at low temperatures (e.g. ambient temperature (40° C. to below 0° C.) present at engine start up. Accordingly, there is a need for crankcase lubricants which exhibit desirable friction characteristics reducing friction losses at start-up of an engine and across the full operating temperature of the engine and thereby improving fuel economy.

SUMMARY OF THE INVENTION

The present invention provides a crankcase lubricating oil composition comprising or made by admixing:

(A) an oil of lubricating viscosity, in a major amount;

(B) an oil-soluble or oil-dispersible molybdenum-containing additive, providing from 600-1500 ppm of molybdenum atoms to the lubricating oil composition, measured according to ASTM D5185, (C) a detergent composition comprising one or more magnesium sulfonate detergents in an amount providing from 200 to 4000 ppm magnesium atoms to the lubricating oil composition, measured according to ASTM D5185, and (D) an oil-soluble or oil-dispersible boron-containing compound present in the lubricating oil composition in an amount sufficient to provide from 200-600 ppm boron atoms to the lubricating oil composition, measured according to ASTM D5185.

In an embodiment of the present invention, the detergent composition further comprises one or more additional detergent additives chosen from magnesium salicylate, magnesium phenate, calcium salicylate, calcium phenate and/or calcium sulfonate detergents. Preferably, a lubricating oil composition of the invention comprises a detergent composition consisting of a mixture of one of more magnesium sulfonate detergents and one or more calcium salicylate detergents.

Unexpectedly, it has been found that the use of a magnesium sulfonate detergent in a lubricating oil composition comprising high quantities of oil-soluble or oil-dispersible molybdenum compound provides an unexpected improvement in the friction performance of the lubricating oil composition, especially at low temperature. Accordingly, the reduction in friction typically translates into improved fuel economy.

The present invention provides a method of lubricating a spark-ignited or compression-ignited internal combustion engine comprising lubricating the engine with a lubricating oil composition as defined in accordance with the present invention.

The present invention further provides the use of a magnesium-containing detergent in a crankcase lubricating oil composition in an amount sufficient to provide from 200-4000 ppm magnesium to the lubricating oil composition, to reduce the boundary friction measurement compared to an equivalent lubricant that does not contain the magnesium-containing detergent in an amount sufficient to provide from 200-4000 ppm magnesium to the lubricating oil composition, measured according to ASTM D5185.

In an embodiment of the use of the present invention the lubricating oil composition further comprises an oil-soluble or oil-dispersible molybdenum compound in an amount sufficient to provide from 500-1500 ppm molybdenum atoms to the lubricating oil composition, measured according to ASTM D5185, and an oil-soluble or oil-dispersible boron-containing compound present in the lubricating oil composition in an amount sufficient to provide from 200-600 ppm boron atoms to the lubricating oil composition, measured according to ASTM D5185.

The lubricant of the present invention is suitably used in the lubrication of the crankcase of a spark-ignited or compression-ignited internal combustion engine.

In an embodiment of the use of the present invention, the magnesium-containing detergent is one or more detergent chosen from the group consisting of oil-soluble neutral and overbased magnesium sulfonates, magnesium phenates, magnesium sulfurized phenates, magnesium thiophosphonates, magnesium salicylates, and magnesium naphthenates and other oil-soluble magnesium carboxylates. Preferably, the magnesium-containing detergent is a magnesium sulfonate.

In accordance with another embodiment of the use of the present invention, the lubricating oil composition further comprises further detergent additives chosen from magnesium salicylate, magnesium phenate, calcium salicylate, calcium phenate and/or calcium sulfonate detergents. Preferably, a lubricating oil composition of the use of the invention comprises a detergent composition consisting of a mixture of one of more magnesium sulfonate detergents and one or more calcium salicylate detergents.

Unexpectedly, it has been found that the use of a magnesium-containing detergents in a lubricating oil composition comprising high quantities of oil-soluble or oil-dispersible molybdenum compound and oil-soluble or oil-dispersible boron-containing compound provides an unexpected improvement in the friction performance of the lubricating oil composition. Such improvement is further improved if the magnesium detergent is magnesium sulfonate and the magnesium sulfonate is used with a calcium-containing detergent, preferably a calcium salicylate detergent. Accordingly, the reduction in friction typically translates into improved fuel economy.

The present invention still further provides the use, in the crankcase lubrication of a spark-ignited or compression-ignited internal combustion engine, of a lubricating oil composition in accordance with the present invention to reduce the coefficient of friction between contacting metal surfaces in the engine during operation of the engine compared to the use of a lubricant that does not contain the magnesium-containing detergent in an amount sufficient to provide from 200-4000 ppm magnesium to the lubricating oil composition (ASTM D5185).

The present invention provides a method of improving the fuel economy performance of a spark-ignited or compression-ignited internal combustion engine, which method comprises lubricating the engine with a lubricating oil composition of the present invention and operating the engine.

In this specification, the following words and expressions, if and when used, have the meanings given below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies;

"hydrocarbyl" means a chemical group of a compound that contains hydrogen and carbon atoms and that is bonded to the remainder of the compound directly via a carbon atom. The group may contain one or more atoms other than carbon and hydrogen provided they do not affect the essentially hydrocarbyl nature of the group. Those skilled in the art will be aware of suitable groups (e.g., halo, especially chloro and fluoro, amino, alkoxyl, mercapto, alkylmercapto, nitro, nitroso, sulfoxy, etc.). Preferably, the group consists essentially of hydrogen and carbon atoms, unless specified otherwise. Preferably, the hydrocarbyl group comprises an aliphatic hydrocarbyl group. The term "hydrocarbyl" includes "alkyl", "alkenyl", "allyl" and "aryl" as defined herein;

"alkyl" means a $C_1$ to $C_{30}$alkyl group which is bonded to the remainder of the compound directly via a single carbon atom. Unless otherwise specified, alkyl groups may, when there are a sufficient number of carbon atoms, be linear (i.e. unbranched) or branched, be cyclic, acyclic or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl;

"aryl" means a $C_6$ to $C_{18}$, preferably $C_6$ to $C_{10}$, aromatic group, optionally substituted by one or more alkyl groups, halo, hydroxyl, alkoxy and amino groups, which is bonded to the remainder of the compound directly via a single carbon atom. Preferred aryl groups include phenyl and naphthyl groups and substituted derivatives thereof, especially phenyl and alkyl substituted derivatives thereof;

"alkenyl" means a $C_2$ to $C_{30}$, preferably a $C_2$ to $C_{12}$, group which includes at least one carbon to carbon double bond and is bonded to the remainder of the compound directly via a single carbon atom, and is otherwise defined as "alkyl";

"alkylene" means a $C_2$ to $C_{20}$, preferably a $C_2$ to $C_{10}$, more preferably a $C_2$ to $C_6$ bivalent saturated acyclic aliphatic radical which may be linear or branched. Representative examples of alkylene include ethylene, propylene, butylene, isobutylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene;

"polyol" means an alcohol which includes two or more hydroxyl functional groups (i.e. a polyhydric alcohol) but excludes a "polyalkylene glycol" (component B(ii)) which is used to form the oil-soluble or oil-dispersible polymeric friction modifier. More specifically, the term "polyol" embraces a diol, triol, tetrol, and/or related dimers or chain extended polymers of such compounds. Even more specifically, the term "polyol" embraces glycerol, neopentyl glycol, trimethylolethane, trimethylolpropane, trimethylolbutane, pentaerythritol, dipentaerythritol, tripentaerythritol and sorbitol;

"polycarboxylic acid" means an organic acid, preferably a hydrocarbyl acid, which includes 2 or more carboxylic acid functional groups. The term "polycarboxylic acid" embraces di-, tri- and tetra-carboxylic acids;

"halo" or "halogen" includes fluoro, chloro, bromo and iodo;

"oil-soluble" or "oil-dispersible", or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired;

"ashless" in relation to an additive means the additive does not include a metal;

"ash-containing" in relation to an additive means the additive includes a metal;

"major amount" means in excess of 50 mass % of a composition expressed in respect of the stated component and in respect of the total mass of the composition, reckoned as active ingredient of the component;

"minor amount" means less than 50 mass % of a composition, expressed in respect of the stated additive and in respect of the total mass of the composition, reckoned as active ingredient of the additive;

"effective minor amount" in respect of an additive means an amount of such an additive in a lubricating oil composition so that the additive provides the desired technical effect;

"ppm" means parts per million by mass, based on the total mass of the lubricating oil composition;

"metal content" of the lubricating oil composition or of an additive component, for example detergent metal, molybdenum or boron content or total metal content of the lubricating oil composition (i.e. the sum of all individual metal contents), is measured by ASTM D5185;

"TBN" in relation to an additive component or of a lubricating oil composition of the present invention, means total base number (mg KOH/g) as measured by ASTM D2896;

"$KV_{100}$" means kinematic viscosity at 100° C. as measured by ASTM D445;

"phosphorus content" is measured by ASTM D5185;

"sulfur content" is measured by ASTM D2622; and,

"sulfated ash content" is measured by ASTM D874.

All percentages reported are mass % on an active ingredient basis, i.e. without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

Also, it will be understood that the preferred features of each aspect of the present invention are regarded as preferred features of every other aspect of the present invention.

DETAILED DESCRIPTION OF THE INVENTION

The features of the invention relating, where appropriate, to each and all aspects of the invention, will now be described in more detail as follows:

Oil of Lubricating Viscosity (A)

The oil of lubricating viscosity (sometimes referred to as "base stock" or "base oil") is the primary liquid constituent of a lubricant, into which additives and possibly other oils are blended, for example to produce a final lubricant (or lubricant composition). A base oil is useful for making concentrates as well as for making lubricating oil compositions therefrom, and may be selected from natural (vegetable, animal or mineral) and synthetic lubricating oils and mixtures thereof.

The base stock groups are defined in the American Petroleum Institute (API) publication "Engine Oil Licensing and Certification System", Industry Services Department, Fourteenth Edition, December 1996, Addendum 1, December 1998. Typically, the base stock will have a viscosity preferably of 3-12, more preferably 4-10, most preferably 4.5-8, $mm^2/s$ (cSt) at 100° C.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.

b) Group II base stocks contain greater than or equal to 90 percent saturates and less than or equal to 0.03 percent sulphur and have a viscosity index greater than or equal to 80 and less than 120 using the test methods specified in Table E-1.

c) Group III base stocks contain greater than or equal to 90 percent saturates and less than or equal to 0.03 percent sulphur and have a viscosity index greater than or equal to 120 using the test methods specified in Table E-1.

d) Group IV base stocks are polyalphaolefins (PAO).

e) Group V base stocks include all other base stocks not included in Group I, II, III, or IV.

TABLE E-1

Analytical Methods for Base Stock

| Property | Test Method |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

Other oils of lubricating viscosity which may be included in the lubricating oil composition are detailed as follows:

Natural oils include animal and vegetable oils (e.g. castor and lard oil), liquid petroleum oils and hydro-refined, solvent-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes)); alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides and the derivatives, analogues and homologues thereof.

Another suitable class of synthetic lubricating oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols, and polyol ethers such as neopentyl glycol, trimethylolpropane, pentaerythritol, dipentaerythritol and tripentaerythritol.

Unrefined, refined and re-refined oils can be used in the compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Re-refined oils are obtained by processes similar to those used to obtain refined oils applied to refined oils which have been already used in service. Such re-refined oils are also known as reclaimed or reprocessed oils and often are additionally processed by techniques for approval of spent additive and oil breakdown products.

Other examples of base oil are gas-to-liquid ("GTL") base oils, i.e. the base oil may be an oil derived from Fischer-Tropsch synthesised hydrocarbons made from synthesis gas containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed.

The composition of the base oil will depend upon the particular application of the lubricating oil composition and the oil formulator will chose the base oil to achieve desired performance characteristics at reasonable cost.

Preferably, the volatility of the oil of lubricating viscosity or oil blend, as measured by the NOACK test (ASTM D5800), is less than or equal to 20%, preferably less than or equal to 16%, preferably less than or equal to 12%, more preferably less than or equal to 10%. Preferably, the viscosity index (VI) of the oil of lubricating viscosity is at least 95, preferably at least 110, more preferably at least 120, even more preferably at least 125, most preferably from about 130 to 140.

The oil of lubricating viscosity is provided in a major amount, in combination with a minor amount of additive components (B) and (C), as defined herein and, if necessary, one or more co-additives, such as described hereinafter, constituting a lubricating oil composition. This preparation may be accomplished by adding the additives directly to the oil or by adding them in the form of a concentrate thereof to disperse or dissolve the additive. Additives may be added to the oil by any method known to those skilled in the art, either before, at the same time as, or after addition of other additives.

Preferably, the oil of lubricating viscosity is present in an amount of greater than 65 mass %, more preferably greater than 70 mass %, even more preferably greater than 75 mass %, based on the total mass of the lubricating oil composition. Preferably, the oil of lubricating viscosity is present in an amount of less than 98 mass %, such as less than 95 mass %, or even less than 90 mass %, based on the total mass of the lubricating oil composition.

Preferably, the lubricating oil composition of the present invention is a multigrade oil identified by the viscometric descriptor SAE 20W-X, SAE 15W-X, SAE 10W-X, SAE 5W-X or SAE 0W-X, where X represents any one of 8, 12, 16, 20, 30, 40 and 50; the characteristics of the different viscometric grades can be found in the SAE J300 classification. The lubricating oil composition is preferably in the form of an SAE 10W-X, SAE 5W-X or SAE 0W-X, more preferably in the form of a SAE 5W-X or SAE 0W-X, wherein X represents any one of 8, 12, 16, 20, 30, 40 and 50. Preferably X is 8, 12, 16 or 20.

Oil-Soluble Molybdenum Compound (B)

For the lubricating oil compositions of the present invention, any suitable oil-soluble or oil-dispersible molybdenum compound having friction modifying properties in lubricating oil compositions may be employed. Preferably, the oil-soluble or oil-dispersible molybdenum compound is an oil-soluble or oil-dispersible organo-molybdenum compound. As examples of such organo-molybdenum compounds, there may be mentioned molybdenum dithiocarbamates, molybdenum dithiophosphates, molybdenum dithiophosphinates, molybdenum xanthates, molybdenum thioxanthates, molybdenum sulfides, and the like, and mixtures thereof. Particularly preferred are molybdenum dithiocarbamates, molybdenum dialkyldithiophosphates, molybdenum alkyl xanthates and molybdenum alkylthioxanthates. An especially preferred organo-molybdenum compound is a molybdenum dithiocarbamate. In an embodiment of the present invention the oil-soluble or oil-dispersible molybdenum compound consists of either a molybdenum dithiocarbamate or a molybdenum dithiophosphate or a mixture thereof, as the sole source of molybdenum atoms in the lubricating oil composition. In an alternative embodiment of the present invention the oil-soluble or oil-dispersible molybdenum compound consists of a molybdenum dithiocarbamate, as the sole source of molybdenum atoms in the lubricating oil composition.

The molybdenum compound may be mono-, di-, tri- or tetra-nuclear. Di-nuclear and tri-nuclear molybdenum compounds are preferred.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate. $MoOCl_4$, $MoO_2Br_2$, $Mo_2O_3Cl_6$, molybdenum trioxide or similar acidic molybdenum compounds. Alternatively, the compositions of the present invention can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897.

Suitable dinuclear or dimeric molybdenum dialkyldithiocarbamate are represented by the following formula:

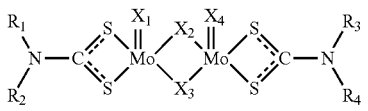

$R_1$ through $R_4$ independently denote a straight chain, branched chain or aromatic hydrocarbyl group having 1 to 24 carbon atoms; and $X_1$ through $X_4$ independently denote an oxygen atom or a sulfur atom. The four hydrocarbyl groups, $R_1$ through $R_4$, may be identical or different from one another.

Other molybdenum compounds useful in the compositions of this invention are organo-molybdenum compounds of the formulae $Mo(ROCS_2)_4$ and $Mo(RSCS_2)_4$, wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Suitable tri-nuclear organo-molybdenum compounds include those of the formula $Mo_3S_kL_nQ_z$ and mixtures thereof wherein L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligands' organo groups, such as at least 25, at least 30, or at least 35 carbon atoms.

The ligands are independently selected from the group of:

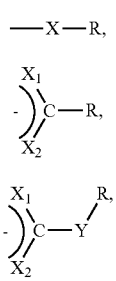

and mixtures thereof, wherein X, $X_1$, $X_2$, and Y are independently selected from the group of oxygen and sulfur, and wherein $R_1$, $R_2$, and R are independently selected from hydrogen and organo groups that may be the same or different. Preferably, the organo groups are hydrocarbyl groups such as alkyl (e.g., in which the carbon atom attached to the remainder of the ligand is primary or secondary), aryl, substituted aryl and ether groups. More preferably, each ligand has the same hydrocarbyl group.

Importantly, the organo groups of the ligands have a sufficient number of carbon atoms to render the compound soluble or dispersible in the oil. For example, the number of carbon atoms in each group will generally range between about 1 to about 100, preferably from about 1 to about 30, and more preferably between about 4 to about 20. Preferred ligands include dialkyldithiophosphate, alkylxanthate, and dialkyldithiocarbamate, and of these dialkyldithiocarbamate is more preferred. Organic ligands containing two or more of the above functionalities are also capable of serving as ligands and binding to one or more of the cores. Those skilled in the art will realize that formation of the compounds of the present invention requires selection of ligands having the appropriate charge to balance the core's charge.

Compounds having the formula $Mo_3S_kL_nQ_z$ have cationic cores surrounded by anionic ligands and are represented by structures such as

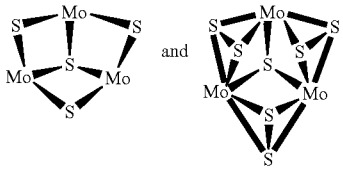

and have net charges of +4. Consequently, in order to solubilize these cores the total charge among all the ligands must be −4. Four mono-anionic ligands are preferred. Without wishing to be bound by any theory, it is believed that two or more tri-nuclear cores may be bound or interconnected by means of one or more ligands and the ligands may be multidentate. This includes the case of a multidentate ligand having multiple connections to a single core. It is believed that oxygen and/or selenium may be substituted for sulfur in the core(s).

Oil-soluble or oil-dispersible tri-nuclear molybdenum compounds can be prepared by reacting in the appropriate liquid(s)/solvent(s) a molybdenum source such as $(NH_4)_2Mo_3S_{13}.n(H_2O)$, where n varies between 0 and 2 and includes non-stoichiometric values, with a suitable ligand source such as a tetralkylthiuram disulfide. Other oil-soluble or dispersible tri-nuclear molybdenum compounds can be formed during a reaction in the appropriate solvent(s) of a molybdenum source such as of $(NH_4)_2Mo_3S_{13}.n(H_2O)$, a ligand source such as tetralkylthiuram disulfide, dialkyldithiocarbamate, or dialkyldithiophosphate, and a sulfur abstracting agent such as cyanide ions, sulfite ions, or substituted phosphines. Alternatively, a tri-nuclear molybdenum-sulfur halide salt such as $[M']_2[Mo_3S_7A_6]$, where M' is a counter ion, and A is a halogen such as Cl, Br, or I, may be reacted with a ligand source such as a dialkyldithiocarbamate or dialkyldithiophosphate in the appropriate liquid(s)/solvent(s) to form an oil-soluble or dispersible trinuclear molybdenum compound. The appropriate liquid/solvent may be, for example, aqueous or organic.

A compound's oil solubility or dispersibility may be influenced by the number of carbon atoms in the ligand's organo groups. Preferably, at least 21 total carbon atoms should be present among all the ligands' organo groups. Preferably, the ligand source chosen has a sufficient number of carbon atoms in its organo groups to render the compound soluble or dispersible in the lubricating composition.

The lubricating oil composition of the present invention contains the molybdenum compound in an amount providing the composition with from 600 to 1500 ppm, preferably from 600-1200 ppm or even from 700 to 1000 ppm of molybdenum (ASTM D5185).

Detergent Composition (C)

Metal detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80 mg KOH/g. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 mg KOH/g or greater, and typically will have a TBN of from 250 to 450 mg KOH/g or more.

According to the present invention, the lubricating oil composition comprises a detergent composition comprising at least one magnesium sulfonate detergent.

The detergent composition of the present invention may comprise one or more additional detergent additive. Suitable additional detergents include, oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. Furthermore, the additional detergent additive may comprise hybrid detergent comprising any combination of sodium, potassium, lithium, calcium, or magnesium salts of sulfonates, phenates, sulfurized phenates, thiophosphonates, salicylates, and naphthenates.

Preferably, the one or more additional detergent additive of the present invention comprises calcium and/or magnesium metal salts. More preferably, the one of more additional detergents additives are selected from magnesium salicylate, calcium salicylate, calcium sulfonate, magnesium phenate, calcium phenate, hybrid detergents comprising two of more of these additional detergent additives and/or combinations thereof.

In a preferred embodiment, the one or more additional detergent additive is a calcium salicylate and/or a calcium sulfonate, most preferably a calcium salicylate. Most preferably, the detergent composition consists of a combination of one or more magnesium sulfonate detergents and one or more calcium salicylate detergents.

If present, any calcium detergent is suitably present in amount sufficient to provide at least 500 ppm, preferably at least 750 more preferably at least 900 ppm atomic calcium to the lubricating oil composition (ASTM D5185). If present, any calcium detergent is suitably present in amount sufficient to provide no more than 4000 ppm, preferably no more than 4000 more preferably no more than 2000 ppm atomic calcium to the lubricating oil composition (ASTM D5185). If present, any calcium detergent is suitably present in amount sufficient to provide at from 500-4000 ppm, preferably from 750-3000 ppm more preferably from 900-2000 ppm atomic calcium to the lubricating oil composition (ASTM D5185).

The magnesium detergent of all aspects of the present invention may be a neutral salt or an overbased salt. Suitably the magnesium detergent of the present invention is an overbased magnesium sulfonate having TBN of from 80 to 500 mg KOH/g (ASTM D2896).

The magnesium detergent of the present invention provides the lubricating oil composition thereof with from 200-4000 ppm of magnesium atoms, suitably from 200-2000 ppm, from 300 to 1500 or from 450-1200 ppm of magnesium atoms (ASTM D5185).

Suitably the total atomic amount of metal from detergent in the lubrication oil composition according to all aspects of the invention is no more than 5000 ppm, preferably no more than 4000 pm and more preferably no more than 2000 ppm (ASTM D5185). The total amount of atomic metal from detergent in the lubrication oil composition according to all aspects of the invention is suitably at least 500 ppm, preferably at least 800 ppm and more preferably at least 1000 ppm (ASTM D5185). The total amount of atomic metal from detergent in the lubrication oil composition according to all aspects of the invention is suitably from 500 to 5000 ppm, preferably from 500 to 3000 ppm and more preferably from 500 to 2000 ppm (ASTM D5185).

Sulfonate detergents may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Suitably the ratio of atomic detergent metal to atomic molybdenum in the lubricating oil composition of all aspects of the present invention is less than 3, preferably less than 2.

Oil-Soluble Boron-Containing Compound (D)

The oil-soluble or oil-dispersible boron containing compound may be any conventional borated lubricant additive. Preferably, the oil-soluble boron containing compound is a borated dispersant, a borate ester or a borated detergent.

Conveniently, the boron containing compound comprises a borated dispersant, especially a borated ashless (i.e. metal free) dispersant. A preferred ashless borated dispersant is a borated polyisobutylene succinimide dispersant.

Dispersants are usually "ashless", being non-metallic organic materials that form substantially no ash on combustion, in contrast to metal-containing, and hence ash-forming materials. They comprise a long hydrocarbon chain (e.g. hydrocarbon polymer backbone) with a polar head, the polarity being derived from inclusion of e.g. an O, P, or N atom. Typically, such dispersants have amine, amine-alcohol or amide polar moieties attached to the hydrocarbon chain, often via a bridging group. The hydrocarbon chain is an oleophilic group that confers oil-solubility, having, for example 40 to 500 carbon atoms. Thus, ashless dispersants may comprise an oil-soluble polymeric backbone. A suitable ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

It is preferred that all the dispersant or dispersants used (including all nitrogen-containing dispersant and any nitrogen-free dispersant) be derived from hydrocarbon polymers having an average number average molecular weight ($M_n$) of from about 600 to 3000, more preferably 700 to 2700, even more preferably 700 to 2500.

A highly preferred ashless dispersant comprises a dispersant that is derived from a polyalkenyl-substituted mono- or di-carboxylic acid, anhydride or ester, most preferably a dispersant that is derived from a polyisobutenyl-substituted mono- or di-carboxylic acid, anhydride or ester.

Suitable hydrocarbons or polymers employed in the formation of the dispersants include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, but-1-ene, hex-1-ene, oct-1-ene, 4-methylpent-1-ene, dec-1-ene, dodec-1-ene, tridec-1-ene, tetradec-1-ene, pentadec-1-ene, hexadec-1-ene, heptadec-1-ene, octadec-1-ene, nonadec-1-ene, and mixtures thereof (e.g., mixtures of propylene and but-1-ene, and the like). Exemplary of such polymers are propylene homopolymers, but-1-ene homopolymers, ethylene-propylene copolymers, ethylene-but-1-ene copolymers, propylene-butene copolymers and the like, wherein the polymer contains at least some terminal and/or internal unsaturation. Preferred polymers are unsaturated copolymers of ethylene and propylene and ethylene and but-1-ene. The interpolymers may contain a minor amount, e.g. 0.5 to 5 mole % of a $C_4$ to $C_{18}$ non-conjugated diolefin comonomer. However, it is preferred that the polymers comprise only alpha-olefin homopolymers, interpolymers of alpha-olefin comonomers and interpolymers of ethylene and alpha-olefin comonomers. The molar ethylene content of the polymers employed is preferably in the range of 0 to 80%, and more preferably 0 to 60%. When propylene and/or but-1-ene are employed as comonomer(s) with ethylene, the ethylene content of such copolymers is most preferably between 15 and 50%, although higher or lower ethylene contents may be present.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75% by wt., and an isobutene content of about 30 to about 60% by wt., in the presence of a Lewis acid catalyst, such as aluminum trichloride or boron trifluoride. A preferred source of monomer for making poly-n-butenes is petroleum feed streams such as Raffinate II. These feedstocks are disclosed in the art such as in U.S. Pat. No. 4,952,739. Polyisobutylene (PIB) is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. In certain embodiments, the polyalkenyl moiety of the dispersant comprises a highly reactive polyisobutylene (HR-PIB), having a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradename Glissopal™ (from BASF).

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

A most preferred dispersant is one comprising at least one polyalkenyl succinimide, especially a polyisobutenyl succinimide, which is the reaction product of a polyalkenyl substituted succinic anhydride (e.g., PIBSA) and a polyamine (PAM). In other words, a most preferred borated dispersant comprises a borated polyalkenyl substituted succinic anhydride (e.g., PIBSA) and a polyamine (PAM). Preferably, such dispersants have a coupling ratio of from about 0.65 to about 1.25, preferably from about 0.8 to about 1.1, most preferably from about 0.9 to about 1. In the context of this disclosure, "coupling ratio" may be defined as a ratio of the number of succinyl groups in the PIBSA to the number of primary amine groups in the polyamine reactant.

Another class of high molecular weight ashless dispersants comprises Mannich base condensation products. Generally, these products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

The dispersant(s) of the present invention are preferably non-polymeric (e.g., are mono- or bis-succinimides). It is further preferred that the dispersant or dispersants contribute, in total, from about 0.10 to about 0.20 wt. %, preferably from about 0.115 to about 0.18 wt. %, most preferably from about 0.12 to about 0.16 wt. % of nitrogen to the lubricating oil composition.

Dispersants can be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids, in an amount sufficient to provide from about 0.1 to about 20 atomic proportions of boron for each mole of acylated nitrogen composition.

The boron, which appears in the product as dehydrated boric acid polymers (primarily $(HBO_2)_3$), is believed to attach to the dispersant imides and diimides as amine salts, e.g., the metaborate salt of the diimide. Boration can be carried out by adding a sufficient quantity of a boron compound, preferably boric acid, usually as a slurry, to the acyl nitrogen compound and heating with stirring at from about 135° C. to about 190° C., e.g., 140° C. to 170° C., for from about 1 to about 5 hours, followed by nitrogen stripping. Alternatively, the boron treatment can be conducted by adding boric acid to a hot reaction mixture of the dicarboxylic acid material and amine, while removing water. Other post reaction processes known in the art can also be applied.

Non-dispersant boron containing compounds include boron oxide, boron oxide hydrate, boron trioxide, boron trifluoride, boron tribromide, boron trichloride, boron acid such as boronic acid, boric acid, tetraboric acid and metaboric acid, boron hydrides, boron amides and various esters of boron acids. Suitable "non-dispersant boron sources" may comprise any oil-soluble, boron-containing compound, but preferably comprise one or more boron-containing additives known to impart enhanced properties to lubricating oil compositions. Such boron-containing additives include, for example, borated dispersant VI improver, alkali metal, mixed alkali metal or alkaline earth metal borate; borated overbased metal detergent; borated epoxide; borate ester; and borate amide.

Alkali metal and alkaline earth metal borates are generally hydrated particulate metal borates, which are known in the art. Alkali metal borates include mixed alkali and alkaline earth metal borates. These metal borates are available commercially. Representative patents describing suitable alkali metal and alkaline earth metal borates and their methods of manufacture include U.S. Pat. Nos. 3,997,454; 3,819,521; 3,853.772; 3,907,601; 3,997,454; and 4,089,790.

The borated amines maybe prepared by reacting one or more of the above boron compounds with one or more of fatty amines, e.g., an amine having from four to eighteen carbon atoms. They may be prepared by reacting the amine with the boron compound at a temperature of from 50 to 300, preferably from 100 to 250° C. and at a ratio from 3:1 to 1:3 equivalents of amine to equivalents of boron compound.

Borated fatty epoxides are generally the reaction product of one or more of the above boron compounds with at least one epoxide. The epoxide is generally an aliphatic epoxide having from 8 to 30, preferably from 10 to 24, more preferably from 12 to 20, carbon atoms. Examples of useful aliphatic epoxides include heptyl epoxide and octyl epoxide. Mixtures of epoxides may also be used, for instance commercial mixtures of epoxides having from 14 to 16 carbon atoms and from 14 to 18 carbon atoms. The borated fatty epoxides are generally known and are described in U.S. Pat. No. 4,584,115.

Borate esters may be prepared by reacting one or more of the above boron compounds with one or more alcohol of suitable oleophilicity. Typically, the alcohol contains from 6 to 30, or from 8 to 24, carbon atoms. Methods of making such borate esters are known in the art.

The borate esters can be borated phospholipids. Such compounds, and processes for making such compounds, are described in EP-A-0 684 298. Borated overbased metal detergents are known in the art where the borate substitutes the carbonate in the core either in part or in full.

In an embodiment of the present invention a borated ashless dispersant as defined herein represents the sole boron containing compound in the lubricating oil composition.

The boron containing compound introduces into the lubricating oil composition greater than 200, preferably greater than 250 ppm of boron, based on the total mass of the lubricating oil composition (ASTM D5185). The boron containing compound introduces into the lubricating oil composition less than 600, preferably less than 500, even more preferably less than 400 ppm of boron, based on the total mass of the lubricating oil composition (ASTM D5185).

Co-Additives

Lubricating oil compositions according to each aspect of the invention may additional comprise one or more co-additives, which are different from additive components (B), (C) and (D). Suitable co-additives and their common treat rates are discussed below. All the values listed are stated as mass percent active ingredient in a fully formulated lubricant.

| Additive | Mass % (Broad) | Mass % (Preferred) |
|---|---|---|
| Ashless Dispersant | 0.1-20 | 1-8 |
| Metal Detergents | 0.1-15 | 0.2-9 |
| Friction modifier | 0-5 | 0-1.5 |
| Corrosion Inhibitor | 0-5 | 0-1.5 |
| Metal Dihydrocarbyl Dithiophosphate | 0-10 | 0-4 |
| Anti-Oxidants | 0-5 | 0.01-3 |
| Pour Point Depressant | 0.01-5 | 0.01-1.5 |
| Anti-Foaming Agent | 0-5 | 0.001-0.15 |
| Supplement Anti-Wear Agents | 0-5 | 0-2 |
| Viscosity Modifier(1) | 0-10 | 0.01-4 |
| Mineral or Synthetic Base Oil | Balance | Balance |

(1)Viscosity modifiers are used only in multi-graded oils.

The final lubricating oil composition, typically made by blending the or each additive into the base oil, may contain from 5 to 25, preferably 5 to 18, typically 7 to 15, mass % of the co-additives, the remainder being oil of lubricating viscosity.

The above mentioned co-additives are discussed in further detail as follows; as is known in the art, some additives can provide a multiplicity of effects, for example, a single additive may act as a dispersant and as an oxidation inhibitor.

Anti-wear agents reduce friction and excessive wear and are usually based on compounds containing sulfur or phosphorous or both, for example that are capable of depositing polysulfide films on the surfaces involved. Noteworthy are dihydrocarbyl dithiophosphate metal salts wherein the metal may be an alkali or alkaline earth metal, or aluminium, lead, tin, molybdenum, manganese, nickel, copper, or preferably, zinc.

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

The preferred zinc dihydrocarbyl dithiophosphates (ZDDP) are oil-soluble salts of dihydrocarbyl dithiophosphoric acids and may be represented by the following formula:

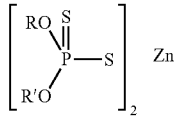

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates.

The ZDDP is added to the lubricating oil compositions in amounts sufficient to provide no greater than 1200 ppm, preferably no greater than 1000 ppm, more preferably no greater than 900 ppm, most preferably no greater than 850 ppm by mass of phosphorous to the lubricating oil, based upon the total mass of the lubricating oil composition, and as measured in accordance with ASTM D5185. The ZDDP is suitably added to the lubricating oil compositions in amounts sufficient to provide at least 200 ppm, preferably at least 350 ppm, more preferably at least 500 ppm by mass of phosphorous to the lubricating oil, based upon the total mass of the lubricating oil composition, and as measured in accordance with ASTM D5185.

The ratio of phosphorus to molybdenum in the lubricating oil composition according to all aspects of the present invention is suitably less than 1.5, preferably less than 1.2 and more preferably less than 1.0.

Examples of ashless anti-wear agents include 1,2,3-triazoles, benzotriazoles, sulfurized fatty acid esters, and dithiocarbamate derivatives.

Ashless dispersants comprise an oil-soluble polymeric hydrocarbon backbone having functional groups that are capable of associating with particles to be dispersed and may be used in addition to any boron-containing compound (D) optionally present in the lubricating oil of any aspect of the invention. Typically, the dispersants comprise amine, alcohol, amide, or ester polar moieties attached to the polymer backbone often via a bridging group. The ashless dispersants may be, for example, selected from oil-soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and a polyalkylene polyamine.

Ashless Friction modifiers, such as nitrogen-free organic friction modifiers are useful in the lubricating oil compositions of the present invention and are known generally and include esters formed by reacting carboxylic acids and anhydrides with alkanols. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26.

Preferred organic ashless nitrogen-free friction modifiers are esters or ester-based; a particularly preferred organic ashless nitrogen-free friction modifier is glycerol monooleate (GMO).

Ashless aminic or amine-based friction modifiers may also be used and include oil-soluble alkoxylated mono- and di-amines, which improve boundary layer lubrication. One common class of such metal free, nitrogen-containing friction modifier comprises ethoxylated alkyl amines. They may be in the form of an adduct or reaction product with a boron compound such as a boric oxide, boron halide, metaborate, boric acid or a mono-, di- or tri-alkyl borate. Another metal free, nitrogen-containing friction modifier is an ester formed as the reaction product of (i) a tertiary amine of the formula $R_1R_2R_3N$ wherein $R_1$, $R_2$ and $R_3$ represent aliphatic hydrocarbyl, preferably alkyl, groups having 1 to 6 carbon atoms, at least one of $R_1$, $R_2$ and $R_3$ having a hydroxyl group, with (ii) a saturated or unsaturated fatty acid having 10 to 30 carbon atoms. Preferably, at least one of $R_1$, $R_2$ and $R_3$ is an alkyl group. Preferably, the tertiary amine will have at least one hydroxyalkyl group having 2 to 4 carbon atoms. The ester may be a mono-, di- or tri-ester or a mixture thereof, depending on how many hydroxyl groups are available for esterification with the acyl group of the fatty acid. A preferred embodiment comprises a mixture of esters formed as the reaction product of (i) a tertiary hydroxy amine of the formula $R_1R_2R_3N$ wherein $R_1$, $R_2$ and $R_3$ may be a $C_2$-$C_4$ hydroxy alkyl group with (ii) a saturated or unsaturated fatty acid having 10 to 30 carbon atoms, with a mixture of esters so formed comprising at least 30-60 mass %, preferably 45-55 mass % diester, such as 50 mass % diester, 10-40 mass %, preferably 20-30 mass % monoester, e.g. 25 mass % monoester, and 10-40 mass %, preferably 20-30 mass % triester, such as 25 mass % triester. Suitably, the ester is a mono-, di- or tri-carboxylic acid ester of triethanolamine and mixtures thereof.

Typically, the total amount of additional organic ashless friction modifier in a lubricant according to the present invention does not exceed 5 mass %, based on the total mass of the lubricating oil composition and preferably does not exceed 2 mass % and more preferably does not exceed 0.5 mass %. In an embodiment of the present invention, the lubricating oil composition contains no additional organic ashless friction modifier.

Viscosity modifiers (VM) function to impart high and low temperature operability to a lubricating oil. The VM used may have that sole function, or may be multifunctional. Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Anti-oxidants, sometimes referred to as oxidation inhibitors, increase the resistance of the composition to oxidation and may work by combining with and modifying peroxides to render them harmless, by decomposing peroxides, or by rendering oxidation catalysts inert. Oxidative deterioration can be evidenced by sludge in the lubricant, varnish-like deposits on the metal surfaces, and by viscosity growth.

Examples of suitable antioxidants are selected from copper-containing antioxidants, sulfur-containing antioxidants, aromatic amine-containing antioxidants, hindered phenolic antioxidants, dithiophosphates derivatives, and metal thiocarbamates. Preferred anti-oxidants are aromatic amine-containing antioxidants, hindered phenolic antioxidants and mixtures thereof. In a preferred embodiment, an antioxidant is present in a lubricating oil composition of the present invention.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used in some embodiments of the invention, and when these compounds are included in the lubricating composition, they are preferably present in an amount not exceeding 0.2 wt. % active ingredient. However, in a preferred embodiment of the present invention, no copper-containing additives are present in the lubricating oil composition. When present, suitable such compounds are the thiadiazole polysulfides containing from 5 to 50 carbon atoms, their derivatives and polymers thereof. Derivatives of 1, 3, 4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK Patent Specification No. 1,560,830. Benzotriazoles derivatives also fall within this class of additives.

A small amount of a demulsifying component may be used. A preferred demulsifying component is described in EP 330522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers, polyalkylmethacrylates and the like.

Foam control can be provided by many compounds including an antifoamant of the polysiloxane type, for example, silicone oil or polydimethyl siloxane.

The individual additives may be incorporated into a base stock in any convenient way. Thus, each of the components can be added directly to the base stock or base oil blend by dispersing or dissolving it in the base stock or base oil blend at the desired level of concentration. Such blending may occur at ambient or elevated temperatures.

Preferably, all the additives except for the viscosity modifier and the pour point depressant are blended into a concentrate or additive package described herein as the additive package that is subsequently blended into base stock to make the finished lubricant. The concentrate will typically be formulated to contain the additive(s) in proper amounts to provide the desired concentration in the final formulation when the concentrate is combined with a predetermined amount of a base lubricant.

The concentrate is preferably made in accordance with the method described in U.S. Pat. No. 4,938,880. That patent describes making a pre-mix of ashless dispersant and metal detergents that is pre-blended at a temperature of at least about 100° C. Thereafter, the pre-mix is cooled to at least 85° C. and the additional components are added.

The final crankcase lubricating oil formulation may employ from 2 to 20, preferably 4 to 18, and most preferably 5 to 17, mass % of the concentrate or additive package with the remainder being base stock.

The lubricating oil composition of the present invention may have a sulfated ash content of less than or equal to 1.2, preferably less than or equal to 1.1, more preferably less than or equal to 1.0, mass % (ASTM D874) based on the total mass of the composition. The lubricating oil composition of the present invention suitably has a sulfated ash content of at least 0.2, preferably at least 0.4, such as at least 0.5 mass % (ASTM D874) based on the total mass of the composition. Suitably the sulfated ash content of the lubricating oil composition is in the range of 0.04-1.2 mass %, preferably in the range of 0.05 to 1.0 mass % (ASTM D874).

The amount of phosphorus in the lubricating oil composition of the present invention contains will depend upon the particular application of the oil. Suitably, the lubricating oil composition contains phosphorus in an amount of less than or equal to 0.12 mass %, preferably up to 0.1 mass %, more preferably less than or equal to 0.09 mass %, even more preferably less than or equal to 0.08 mass % of phosphorus (ASTM D5185) based on the total mass of the composition. Suitably, the lubricating oil composition contains phosphorus in an amount of greater than or equal to 0.01, preferably greater than or equal to 0.02, more preferably greater than or equal to 0.03, even more preferably greater than or equal to 0.05 mass % of phosphorus (ASTM D5185) based on the total mass of the composition.

The amount of sulfur in the lubricating oil composition will depend upon the particular application of the lubricating oil composition. The lubricating oil composition may contain sulphur in an amount of up to 0.4, such as, up to 0.35 mass % sulphur (ASTM D2622) based on the total mass of the composition. Generally the lubricating oil composition will contain at least 0.1, or even at least 0.2 mass % sulphur (ASTM D2622) based on the total mass of the composition.

The amount of nitrogen in a lubricating oil composition according to the present invention will depend upon the particular application of the oil. Typically, a lubricating oil composition according to the present invention contains at least 0.02, such as at least 0.03 or 0.04 mass % nitrogen, based on the total mass of the composition and as measured according to ASTM method D5291. Suitably, the lubricating oil composition will contain no more than 0.20, such as no more than 0.15 or no more than 0.12 mass % nitrogen based upon the total mass of the composition and as measured according to ASTM D5291.

Suitably, the lubricating oil composition of all aspects and embodiments of the present invention may have a total base number (TBN), as measured in accordance with ASTM D2896, of 4 to 15, preferably 5 to 12 mg KOH/g.

EXAMPLES

The invention will now be described in the following examples which are not intended to limit the scope of the claims hereof.

A series of oils were testing in the High Frequency Reciprocating Rig (HFRR-supplied by PCS Instruments) to evaluate the boundary regime friction characteristics of the oils.

The rig was set up with a 6 mm ball on a 10 mm disc. The test protocol employed was as follows:

| | |
|---|---|
| Test Duration (mins) | 1 min hold and 5 min run at each s temperature tage |
| Test Load (N) | 4 |
| Frequency (Hz) | 40 |
| Stroke Length (microns) | 1,000 |
| Temperature (° C.) | 40, 60, 80, 100, 120, 140 |

The test has 6 temperature stages and you can record the average friction at each temperature stage and the overall average friction across all stages.

Four comparative oils (indicated by the C- prefix) and five oils according to the invention (indicated by the I- prefix) were tested. The composition of each oil is set out in Table I below, together with the average HFRR friction across the all stages of the test and the low temperature HFRR friction, which is the average of the 40° C. and 60° C. stages of the test.

A comparison of Oil C-1, Oil C-3 and Oil I-3 shows that inclusion of high levels of molybdenum in a lubricating oil comprising either magnesium or calcium detergents improves the average HFRR friction performance of the oil, as expected. A comparison of Oil C-3 and Oil I-3 also shows that this is further improved when the calcium detergent is replaced by a magnesium detergent. This further improvement resulting from the replacement of the calcium detergent with a magnesium detergent is unexpected.

A comparison of Oil C-3 and Oil C-4 and a comparison of Oil I-1 and Oil I-3 shows that in the presence of high treat rate of molybdenum, addition of significant treat rates of boron also improves the HFRR friction performance, which is unexpected.

A comparison of Oil I-1 and Oil I-2 shows that changing the magnesium salicylate detergent to a magnesium sulfonate detergent in otherwise comparable oils significantly improves the low temperature friction performance, whilst maintaining the improved performance exhibited by use of the magnesium detergent compared to the calcium detergent referred to above. This improvement in low temperature friction performance is unexpected.

Finally, a comparison of Oil I-4 and Oil I-5 shows that the best improvement of average HFRR friction can be obtained when a combination of calcium and magnesium detergent is used, and again the presence of magnesium sulfonate detergent in the calcium/magnesium detergent mixture further improves the low temperature friction performance.

TABLE 1

| Component | Oil C-1 Mass % | Oil C-2 Mass % | Oil C-3 Mass % | Oil C-4 Mass % | Oil I-1 Mass % | Oil I-2 Mass % | Oil I-3 Mass % | Oil I-4 Mass % | Oil I-5 Mass % |
|---|---|---|---|---|---|---|---|---|---|
| Molybdenum Compound[1] | 0 | 0 | 2.0 | 2.0 | 2.0 | 2.0 | 2.0 | 2.0 | 2.0 |
| Calcium Salicylate[2] | 0 | 0 | 1.75 | 1.75 | 0 | 0 | 0 | 0.84 | 0.88 |
| Magnesium Salicylate[3] | 0.73 | 0.73 | 0 | 0 | 0.73 | 0 | 0.73 | 0.39 | 0 |
| Magnesium Sulfonate[4] | 0 | 0 | 0 | 0 | 0 | 0.65 | 0 | 0 | 0.33 |
| Borated dispersant[5] | 0 | 0.55 | 0 | 0.55 | 0.55 | 0.55 | 0 | 0.55 | 0.55 |

TABLE 1-continued

| Component | Oil C-1 Mass % | Oil C-2 Mass % | Oil C-3 Mass % | Oil C-4 Mass % | Oil I-1 Mass % | Oil I-2 Mass % | Oil I-3 Mass % | Oil I-4 Mass % | Oil I-5 Mass % |
|---|---|---|---|---|---|---|---|---|---|
| Additional Additives[6] | 3.39 | 3.39 | 3.39 | 3.39 | 3.39 | 3.39 | 3.39 | 3.39 | 3.39 |
| Mo, ppm (ASTM D5185) | 0 | 0 | 980 | 980 | 980 | 980 | 980 | 980 | 980 |
| B, ppm (ASTM D5185) | 0 | 299 | 0 | 299 | 299 | 299 | 0 | 299 | 299 |
| Mg, mass % (ASTM D5185) | 0.10 | 0.10 | 0 | 0 | 0.10 | 0.10 | 0.10 | 0.05 | 0.05 |
| Ca, mass % (ASTM D5185) | 0 | 0 | 0.2 | 0.2 | 0 | 0 | 0 | 0.11 | 0.10 |
| P, mass % (ASTM D5185) | 0.075 | 0.075 | 0.075 | 0.075 | 0.075 | 0.075 | 0.075 | 0.075 | 0.075 |
| SASH, mass %(ASTM D374) | 0.6 | 0.6 | 0.8 | 0.9 | 0.6 | 0.6 | 0.6 | 0.7 | 0.7 |
| Average HFRR friction | 0.156 | 0.158 | 0.100 | 0.082 | 0.081 | 0.080 | 0.086 | 0.070 | 0.077 |
| Low temperature HFFR friction | 0.136 | 0.141 | 0.122 | 0.111 | 0.085 | 0.078 | 0.098 | 0.086 | 0.074 |

[1]The molybdenum compound was Infincum C9401, a dimeric molybdenum dithiocarbamate available from Infincum UK Ltd.

[2]The calcium salkylate was a Infincum C9329 an overbased detergent having a TBN of 229 and 8 mass % Ca available from Infincum UK Ltd

[3]The magnesium salicylate was Infincum C9012 an overbased detergent having a TBN of 342 and 7.4 mass % Mg available from Infincum UK Ltd

[4]The magnesium sulfonate was Infincum C9340 and overbased detergent having a TBN of 400 and 9.1 mass % Mg available from Infincum UK Ltd

[5]The borated dispersant was Infincum C9202 a borated ashless polyisobutenyl succimimide dispersant containing 2.3 mass % B available from Infincum UK Ltd

[6]The additional additives are provided by a detergent inhibitor package comprising non-borated dispersant, zinc dialkyldithiophosphate, and antioxidant. The amount of each of these additives was the same in each oil tested.

What is claimed is:

1. A crankcase lubricating oil composition comprising or made by admixing:

(A) an oil of lubricating viscosity, in a major amount;

(B) an oil-soluble or oil-dispersible molybdenum dithiocarbamate additive, providing from 700-1000 ppm of molybdenum atoms to the lubricating oil composition;

(C) a detergent composition comprising one or more overbased magnesium sulfonate detergents having or having on average a TBN of 150 to 500 mgKOH/g, in an amount providing from 450-1200 ppm of magnesium atoms to the lubricating oil composition, measured according to ASTM D5185; and (D) an oil-soluble or oil-dispersible boron-containing succinimide dispersant compound present in the lubricating oil composition in an amount sufficient to provide from 200-400 ppm boron atoms to the lubricating oil composition, measured according to ASTM D5185.

2. A lubricating oil composition according to claim 1, wherein the detergent composition comprises one or more additional detergent additive selected from magnesium salicylate, calcium salicylate, calcium sulfonate, magnesium phenate, and calcium phenate, hybrid detergents comprising two or more of these additional detergent additives and/or combinations thereof.

3. A lubricating oil composition according to claim 2, wherein the detergent composition further comprises at least one detergent selected from calcium salicylate detergent and calcium sulfonate detergent.

4. A lubricating oil composition according to claim 3, wherein the detergent composition consists of one or more overbased magnesium sulfonate detergents and one or more calcium salicylate detergents.

5. A lubricating oil composition according to claim 3, wherein calcium-containing detergent is present in an amount sufficient to provide from 900-2000 ppm atomic calcium to the lubricating oil composition, measured according to ASTM D5185.

6. A lubricating oil composition according to claim 4, wherein calcium-containing detergent is present in an amount sufficient to provide 900-2000 ppm atomic calcium to the lubricating oil composition, measured according to ASTM D5185.

7. A method of lubricating a spark-ignited or compression-ignited internal combustion engine comprising lubricating the engine with a lubricating oil composition as defined in accordance with claim 1.

8. A method of lubricating a spark-ignited or compression-ignited internal combustion engine comprising lubricating the engine with a lubricating oil composition as defined in accordance with claim 4.

9. A method of lubricating a spark-ignited or compression-ignited internal combustion engine comprising lubricating the engine with a lubricating oil composition as defined in accordance with claim 6.

* * * * *